US005636460A

United States Patent [19]

Dretzka

[11] Patent Number: 5,636,460

[45] Date of Patent: Jun. 10, 1997

[54] DRAGLINE WITH CANTILEVERED SIDE-ACCESS DUMP BLOCK

[75] Inventor: Andrew P. Dretzka, Cudahy, Wis.

[73] Assignee: Harnischfeger Corporation, Brookfield, Wis.

[21] Appl. No.: 529,868

[22] Filed: Sep. 18, 1995

[51] Int. Cl.[6] ..... B66D 3/04

[52] U.S. Cl. ..... 37/397; 37/399; 254/415; 254/416

[58] Field of Search ..... 37/396, 397, 398, 37/399; 254/415, 416, 390; 212/201, 240, 252, 253, 262, 83

[56] References Cited

U.S. PATENT DOCUMENTS

| | | | |
|---|---|---|---|
| 347,443 | 8/1886 | Roe et al. . | |
| 856,335 | 6/1907 | Callahan . | |
| 1,111,118 | 9/1914 | Williamson . | |
| 1,699,630 | 1/1929 | Pilkington . | |
| 1,732,942 | 10/1929 | Martinson et al. | 37/399 X |
| 1,826,920 | 10/1931 | Brendlin | 37/399 |
| 1,836,867 | 12/1931 | Page | 37/399 X |
| 1,968,321 | 7/1934 | Shope | 254/416 X |
| 2,738,955 | 3/1956 | Franics | 254/190 |
| 2,754,011 | 7/1956 | Maki | 212/1 |
| 3,807,696 | 4/1974 | Brda | 254/154 |
| 3,834,674 | 9/1974 | Jackson | 254/190 R |
| 4,549,723 | 10/1985 | Castilano | 254/405 |
| 4,640,496 | 2/1987 | Van Hoomissen et al. | 254/416 X |
| 5,321,902 | 6/1994 | Gregory | 37/399 X |
| 5,349,766 | 9/1994 | Dutton | 37/397 |
| 5,398,433 | 3/1995 | Dretzka | 37/399 |
| 5,428,909 | 7/1995 | Immel | 37/399 |

FOREIGN PATENT DOCUMENTS 708448 1/1980 U.S.S.R. .

*Primary Examiner*—Terry Lee Melius
*Assistant Examiner*—Robert Pezzuto
*Attorney, Agent, or Firm*—Michael, Best & Friedrich

[57] ABSTRACT

A dragline comprising a main housing, a bucket hoist mechanism mounted on the housing, a bucket drag mechanism mounted on the main housing, a moving mechanism for moving the main housing over the ground, a boom which is supported on the main housing and which has an upper end, a bucket, a hoist rope having one end connected to the bucket hoist mechanism, extending over the sheave, and having an opposite end, a drag rope extending between the bucket and the bucket drag mechanism, a dump block including a frame having a main portion connected to the opposite end of the hoist rope, and a cantilevered spindle extending from the main portion, and a dump block sheave mounted on the spindle for rotation about a sheave axis, and a dump rope extending over the dump block sheave and having one end connected to the drag rope and an opposite end connected to the bucket, such that the dump rope can be removed from the sheave in the direction away from the frame main portion.

24 Claims, 9 Drawing Sheets

DRAGLINE WITH CANTILEVERED SIDE-ACCESS DUMP BLOCK

BACKGROUND OF THE INVENTION

The invention relates to draglines. A dragline typically includes a main housing movable over the ground, and a boom which extends upwardly and outwardly from the main housing. The upper end of the boom has thereon a sheave mounted for rotation about a horizontal axis. A drag rope extends from a bucket drag mechanism to a bucket for causing horizontal movement of the bucket relative to the boom. A hoist rope extends from a bucket hoist mechanism and over the sheave to the bucket for causing vertical movement of the bucket. More particularly, a dump block is connected to the end of the hoist rope, and a dump rope extends over the dump block sheave and has one end connected to the drag rope and an opposite end connected to the bucket.

The majority of current dump blocks are of a rigid frame design. The dump rope (typically wire rope) cannot be easily removed. One must either first remove a socket from the end of the rope and then slip the rope out of the dump block, or remove an upper pin, spacer(s) and rope guide to get access to the rope. As bucket performance is greatly affected by dump rope length, many mines are wishing to use "pre-socketed" ropes. These ropes come from the factory set at a specific length and with nonremovable socket ends attached. This prevents maintenance crews from either accidentally or intentionally changing the dump rope length and affecting the bucket performance and/or structural loading. In rigging configurations using a dual dump rope, uneven loading occurs if the ropes are not of equal length.

Two solutions to this currently exist in the market. One design uses an upper hood that rotates once a pin/bolt is removed. Sometimes, an upper spacer must also be removed. The hood is attached to the rigging above it and is extremely difficult to maneuver as this rigging weighs many thousands of pounds on all but the smallest of buckets. Another design also allows side access but needs tools (hammer and punch) to remove a pin to allow a heavy door to rotate down out of the way. This design also requires the frame to wrap around the bottom of the dump block so a conventional small pin and bearings may be used. This pin and bearing design is virtually the same as the rigid frame designs in use by many manufacturers and provides virtually no stability to the frame halves. It also creates an excessively heavy frame with the design being nearly twice as heavy as the rigid frame design.

SUMMARY OF THE INVENTION

The invention provides a new dump block design that allows easy access for pre-socketed (although unsocketed ropes may still be used) ropes, requires no tools to change the rope and suffers only a slight weight gain. This is accomplished by placing the sheave and bearings on a cantilevered spindle protruding from a single frame. This eliminates the other side frame as an obstruction to getting the rope in and out of the dump block.

The design consists of a single frame which provides for attachment to the upper rigging. An end cap holds the assembly together and also provides adjustment and protection for the bearings and seals. The sheave may be of a steel or nylon material. The frame contains an integral guard for protection of one side of the sheave perimeter. The other side uses a guard that bolts onto and rotates with the sheave or sheave support (used only with a nylon sheave). The nylon sheave is clamped in place by the guard to keep it from moving relative to its support. This allows for easy replacement of the nylon sheave. (Most applications require the sheave to be pressed onto the supporting structure.) The sheave or sheave support mounts on bearings which rotate about the cantilever spindle. An alternative guard design is one which is integral with the end cap and so does not rotate with the sheave.

The rope is kept from coming out of the sheave by rollers which rotate by hand out of the way to allow for rope removal or replacement. The rollers are held in place during operation by a locking lever or pin which is moveable by hand. The sheave is machined specifically for each diameter of rope to be used (different rope sizes for different bucket sizes) and in conjunction with the rollers substantially prevents the rope from squeezing out of the dump block. Each roller preferably has thereon a flange designed such that, with each specific rope size, wedging action of the rope between the sheave and the roller, as would occur with a straight roller, is substantially prevented.

Neither design requires any tools as do the previously mentioned spacers or heavy door. The design also allows for the inclusion of an automatic lube injector in the spindle cavity.

Other features and advantages of the invention will become apparent to those skilled in the art upon review of the following detailed description, claims and drawings.

Figure 1:
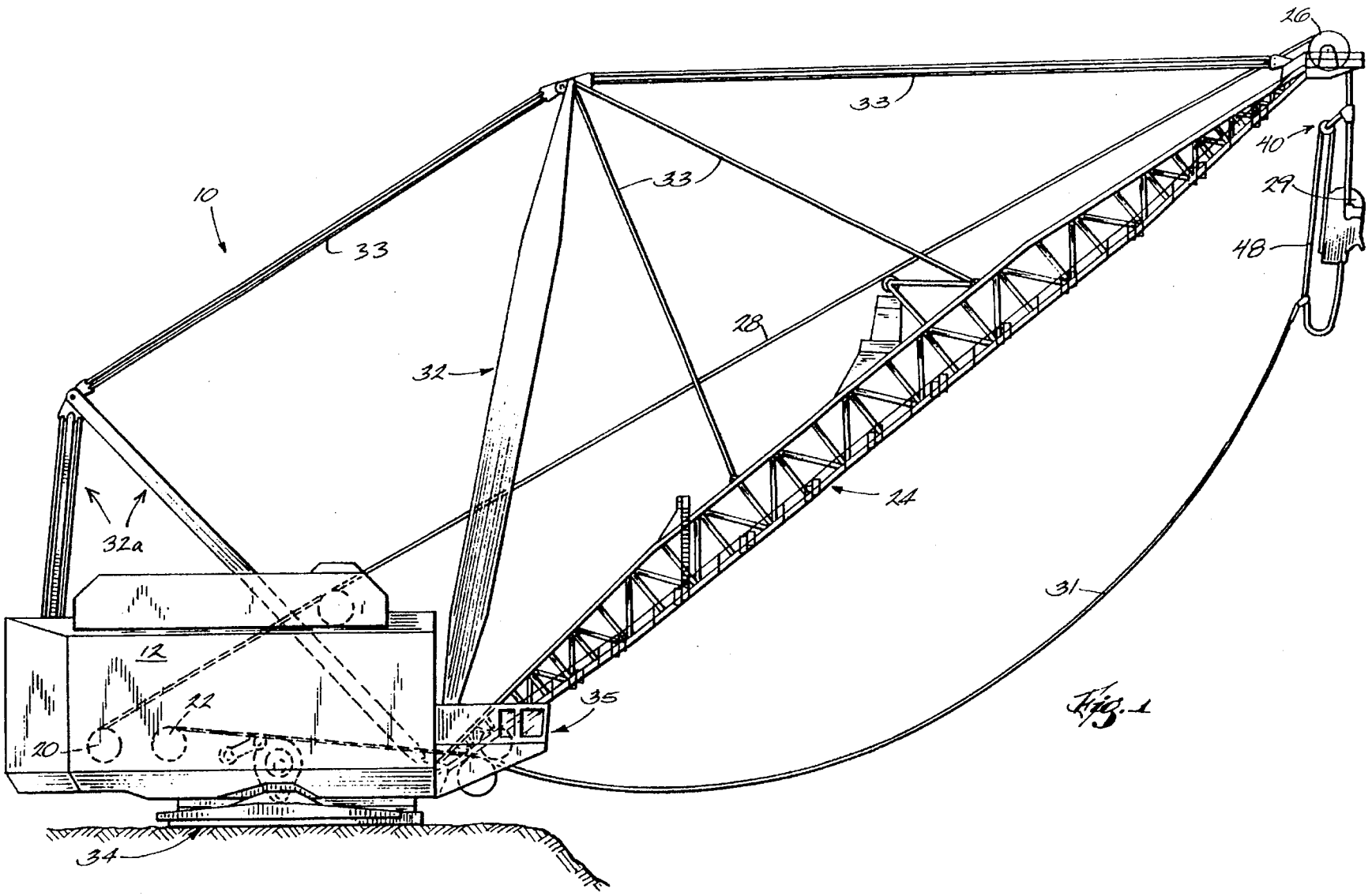
FIG. 1 is a side elevational view of a dragline embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A walking dragline 10 embodying the invention is illustrated in the drawings. The dragline 10 comprises (see FIG.

1) a main housing 12. A bucket hoist mechanism 20 and a bucket drag mechanism 22 are mounted on the main housing 12. A boom 24 extends upwardly and outwardly from the main housing 12. The upper end of the boom 24 has thereon a rope guiding member or sheave 26 which is rotatable about a horizontal axis. A hoist rope 28 extends from the bucket hoist mechanism 20 over the sheave 26 to a bucket 29 for causing vertical movement of the bucket 29 relative to the boom 24. The manner in which the hoist rope 28 is connected to the bucket 29 is described below. A drag rope 31 extends from the bucket drag mechanism 22 to the bucket 29 for causing horizontal movement of the bucket 29. The boom 24 is supported relative to the main housing 12 by a conventional mast 32 and A-frame 32*a*. Support lines 33 are connected between the upper ends of the mast 32 and A-frame 32*a* and the boom 24 for supporting the boom 24. -When the dragline 10 is digging, the main housing 12 is supported by a tub that sits on the ground and allows the machine to rotate. A pair of walking mechanisms 34 (one shown) move the main housing 12 over the ground between digging operations. The main housing 12 includes an operator's cab 35. The dragline 10 as thus far described is conventional.

Figure 2:
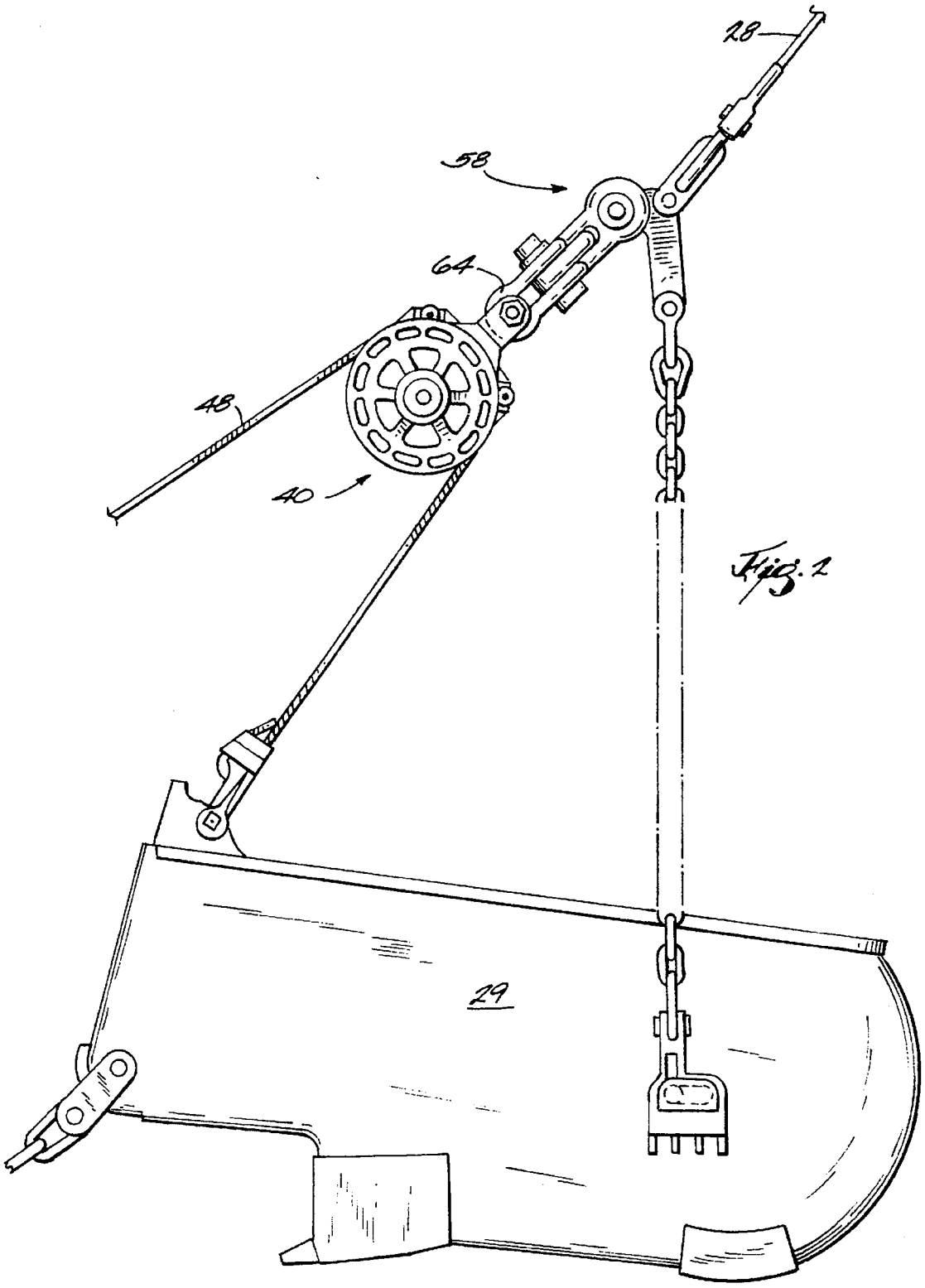
FIG. 2 is an enlarged elevational view of the bucket and a dump block.
Figure 3:
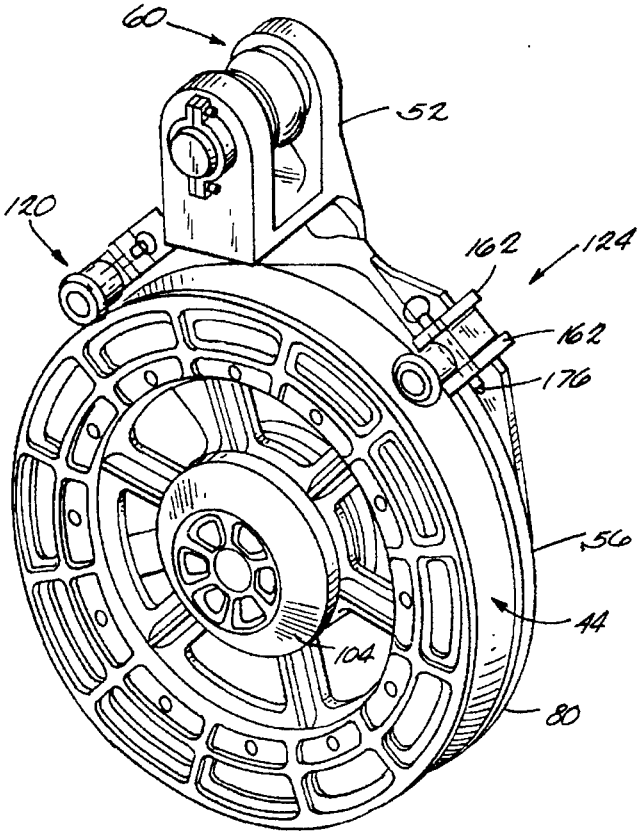
FIG. 3 is a perspective view of one side of the dump block.
Figure 4:
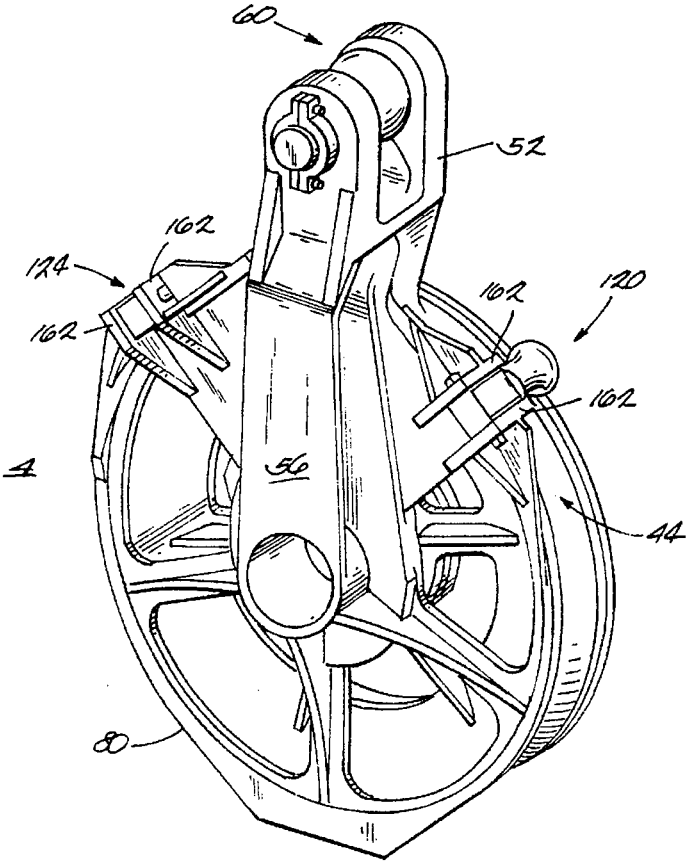
FIG. 4 is a perspective view of the other side of the dump block.

As best shown in FIG. 2, the end of the hoist rope 28 is connected to upper rigging 58 which is in turn connected to a pair of dump blocks 40 (only one is shown). It should be understood that a single dump block could be used. The dump blocks 40 are substantially identical, and only one will be described in detail. The dump block 40 includes a sheave 44 (see FIGS. 3, 4 and 6), which can be either a steel sheave or a nylon sheave on a sheave support, as explained more fully below. A dump rope 48 (see FIGS. 1, 2 and 7) extends over the sheave 44 and has one end connected to the drag rope 31 and an opposite end connected to the bucket 29.

The dump block 40 is illustrated in greater detail in FIGS. 3–9. The dump block 40 includes a frame 52 having a main portion 56 connected to the hoist rope 28 by the upper rigging 58 (see FIG. 2). The upper end of the frame main portion 56 has thereon a roller 60 (see FIGS. 3, 4 and 6), and the upper rigging 58 includes (see FIG. 2) a clevis 64 connected to the roller 60 such that the frame main portion 56 can freely pivot relative to the upper rigging 58 about the roller 60. The frame 52 also includes (see FIG. 6) a cantilevered spindle 68 extending from the frame main portion 56 (to the left in FIG. 6). The spindle 68 has a cylindrical outer surface 72 (see FIG. 8) and has therethrough (see FIG. 6) an internal passageway 76. The frame 52 also includes an integral sheave guard 80 for protecting one side (the right side in FIG. 6) of the dump block sheave 44, which is mounted on the spindle 68 for rotation relative thereto about a sheave axis 84 concentric with the spindle outer surface 72. The sheave 44 is supported relative to the spindle 68 by a bearing assembly 88 (see FIGS. 6 and 8) which is described below in detail. The bearing assembly 88 is lubricated through one or more grease fittings 92 or by a lube injector canister 94 (both shown in FIG. 6) accessible through the internal passageway 76.

Figure 6:
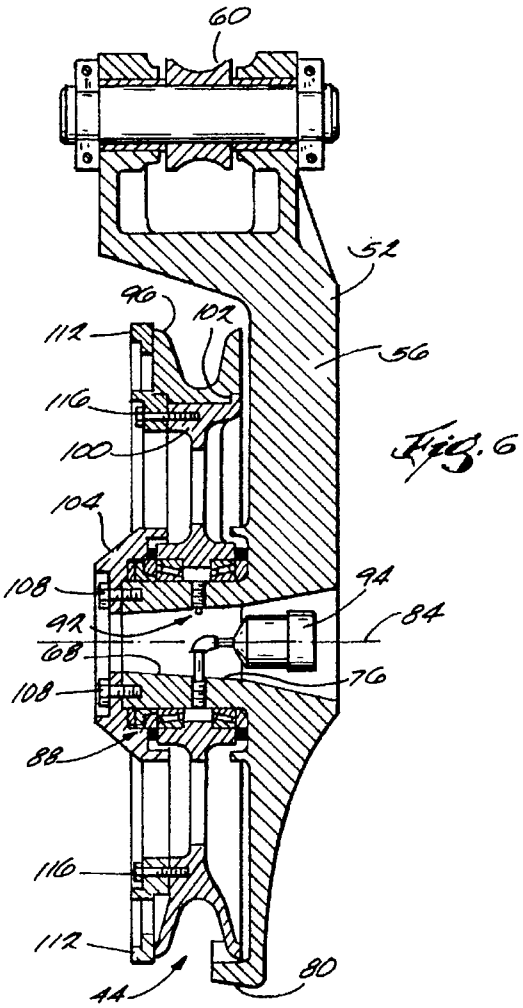
FIG. 6 is a view taken along line 6—6 in FIG. 5.
Figure 5:
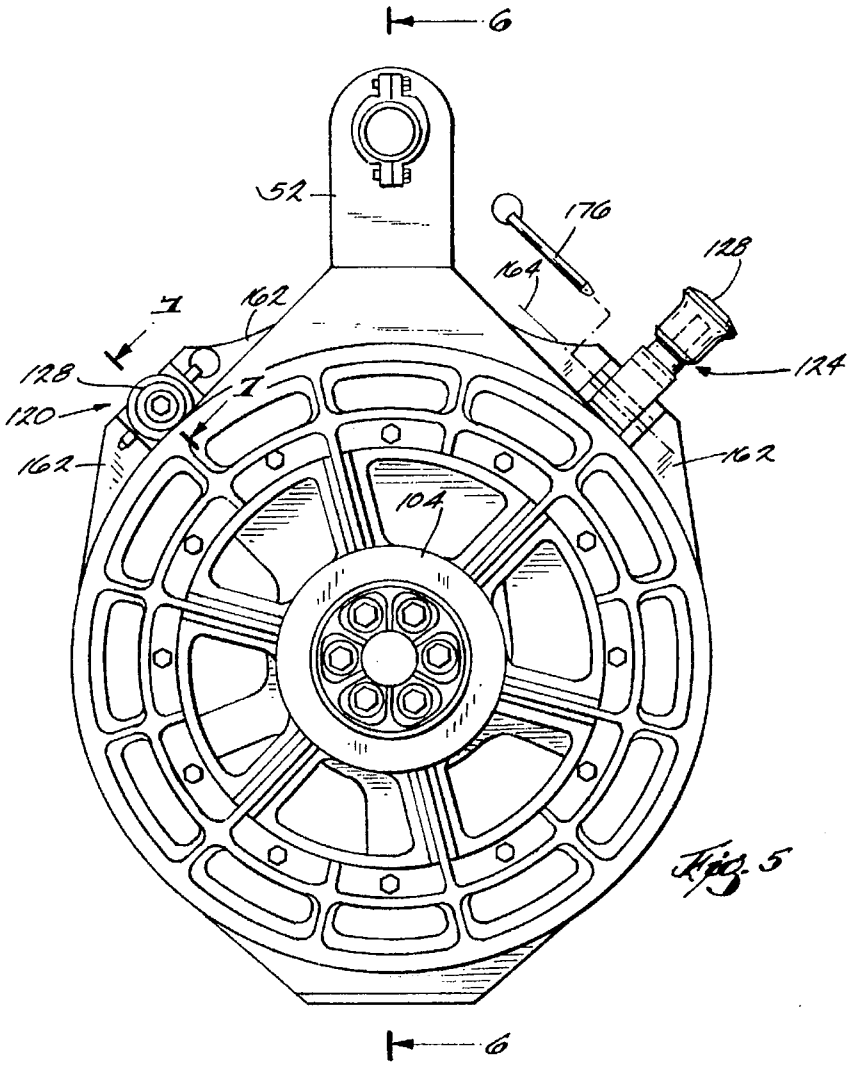
FIG. 5 is an elevational view of the side of the dump block shown in FIG. 3.
Figure 7:
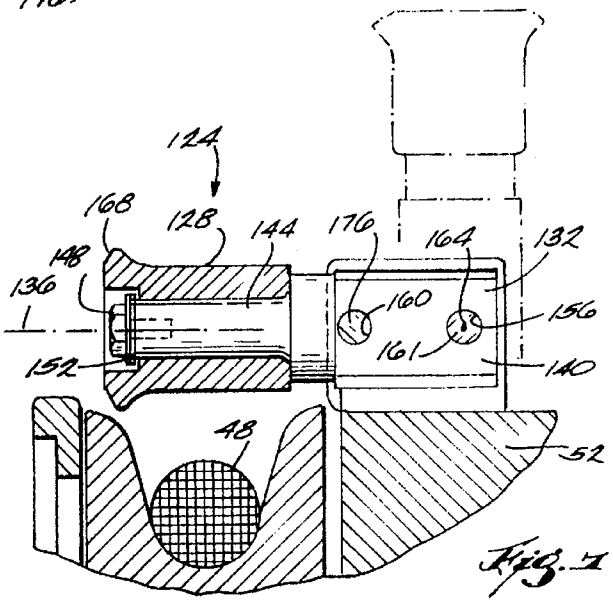
FIG. 7 is a view taken along line 7—7 in FIG. 5.

Two sheave constructions are illustrated in FIG. 6. As shown below the spindle 68, the sheave 44 is one piece and is made of steel or cast as a solid piece of nylon. As shown above the spindle 68, an annular nylon sheave 96 is mounted on an annular sheave support 100, which is supported on the spindle 68 by the bearing assembly 88. The sheave support 100 may be steel, aluminum, or any number of lightweight materials since it is not a wear-type item. The sheave support 100 has a radially extending shoulder 102 (see FIG. 6).

The dump block 40 also includes an end cap 104 secured to the outer end of the spindle 68 by suitable means such as bolts 108. The end cap 104 holds the sheave 44 and the bearing assembly 88 on the spindle 68 and also provides adjustment and protection for the bearing assembly 88, as described below. A sheave guard 112 is secured to the outside of either the sheave 44 or the sheave support 100 by suitable means such as bolts 116. When used with the nylon sheave 96, the sheave guard 112 clamps the nylon sheave 96 in place relative to the sheave support 100. Specifically, the sheave guard 112 presses the nylon sheave 96 axially against the shoulder 102 on the sheave support 100. The sheave guard 112 rotates with the sheave 44 and protects the outside of the sheave 44 (the left side in FIG. 6). Alternatively, the sheave guard 112 could be integral with the end cap 104, in which case the sheave 44 guard would not rotate with the sheave 44.

The dump block 40 also includes (see FIGS. 3–5 and 7) retaining assemblies 120 and 124 for substantially preventing the dump rope 48 from coming out of the sheave 44. The retaining assemblies 120 and 124 are substantially identical, and only the assembly 124 will be described in detail. The retaining assembly 124 includes (see FIG. 7) a roller 128 mounted on a roller support 132 for rotation about a roller axis 136 which moves with the roller support 132. The roller support 132 includes a generally rectangular block portion 140 and a spindle portion 144 extending from the block portion 140. The roller 128 is rotatably mounted on the spindle portion 144 and is held in place by a bolt 148 and a washer 152. The block portion 140 has therethrough first and second or right and left apertures 156 and 160, respectively. A pin 161 extends through ears 162 (see FIGS. 3–5) on the frame main portion 56 and through the right aperture 156 such that the roller support 132 can pivot relative to the frame 52 about a support axis 164 (see FIGS. 5 and 7) which is transverse to the sheave axis 84. The roller support 132 is pivotable relative to the frame 52 between a retaining position (shown in solid lines in FIG. 7) and a release position (shown in phantom in FIG. 7). When the roller support 132 is in the retaining position, the roller axis 136 is parallel to the sheave axis 84 and the roller 128 extends over the sheave 44 to retain the dump rope 48 on the sheave 44. The outer end of the roller 128 has thereon (see FIG. 7) a flange 168 for substantially preventing the dump rope 48 from becoming wedged between the roller 128 and the sheave 44. When the roller support 132 is in the release position, the roller 128 permits removal of the dump rope 48 from the sheave 44.

Means are provided for releaseably securing the roller support 132 in the retaining position. While various suitable means can be employed, in the illustrated construction, the frame ears 162 have therein apertures (not shown) which are aligned with the left aperture 160 in the roller support 132 when the roller support 132 is in its retaining position, and a pin 176 (see FIGS. 3, 5 and 7) is removeably inserted into the apertures in the ears 162 and the apertures 160 to releaseably secure the roller support 132 in its retaining position.

The dump rope 48 can be easily removed from the dump block 40 by simply moving the rollers 128 to their release positions and removing the rope 48 from the sheave 44 in the direction away from the frame main portion 56. The pins 176 can be removed manually. No tools are required. This is much easier and less time consuming than with known prior arrangements.

Figure 12:
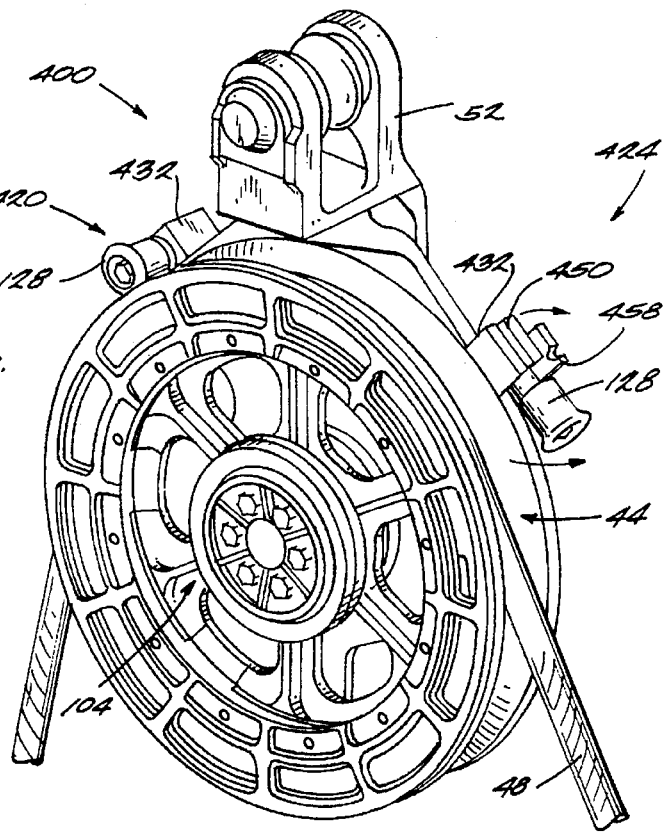
FIG. 12 is a perspective view of one side of the dump block showing an alternative roller arrangement.
Figure 13:
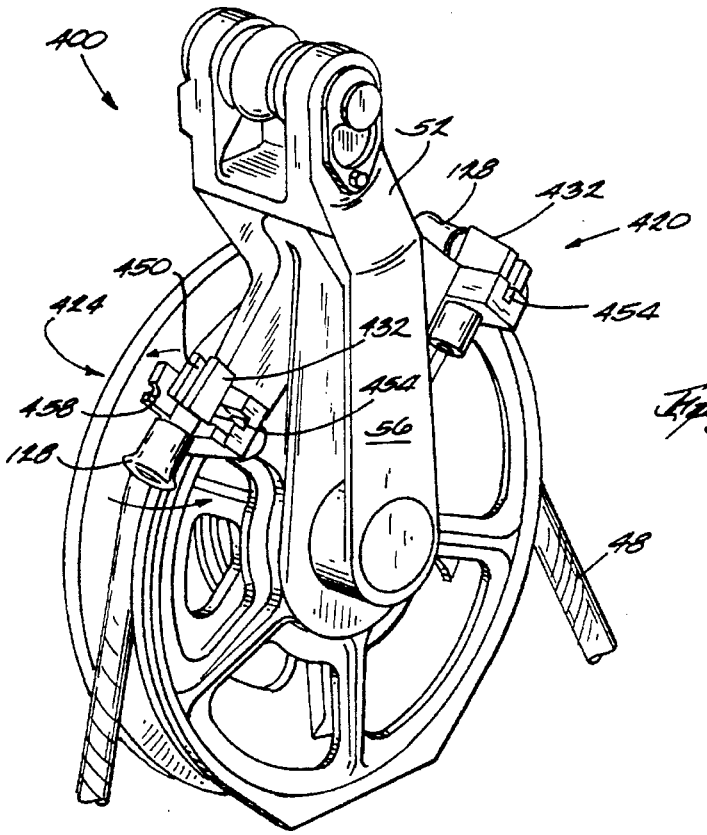
FIG. 13 is a perspective view of the other side of the dump block showing the alternative roller arrangement.

It should be understood that other roller arrangements could be used to prevent the rope 48 from coming out of the sheave 44. For example, as shown in FIGS. 12 and 13 and as described below, the rollers could pivot about an axis extending radially of the sheave 44, and other means could be used to releaseably secure the rollers.

The bearing assembly 88 will now be described in detail. The spindle 68 can be considered an inner member having an axis 84, an axially extending outer surface 72, and a radially extending surface 180 (see FIG. 8) perpendicular to the outer surface 72. The sheave 44 can be considered an outer member rotatable about the axis 84 relative to the inner member or spindle 68. The outer member or sheave 44 has an axially extending inner surface 184 including a first or inner shoulder 188 facing inwardly or toward the surface 180 (to the right in FIG. 8) and a second or outer shoulder 192 facing outwardly or away from the surface 180 (to the left in FIG. 8).

The bearing assembly 88 includes (see FIG. 8) axially inner and outer bearings 196 and 200, respectively, which are preferably tapered roller bearings. Each of the bearings 196 and 200 includes an inner race 204 abutting the spindle outer surface 72, an outer race 208 abutting the sheave inner surface 184, and a plurality of rollers 212 between the inner and outer races. The inner race 204 of the bearing 200 has a radially extending bearing surface 214. This construction is conventional and will not be described in greater detail. The inner bearing 196 is captured between the sheave inner shoulder 188 and the spindle surface 180. A spacer 216 is preferably located between the inner bearing 196 and the spindle surface 180, and a seal 220 surrounds the spacer 216 between the sheave 44 and the spindle surface 180. The outer bearing 200 is captured between a bearing retainer assembly 224 and the sheave outer shoulder 192.

The bearing retainer assembly 224 includes a first or radially outer ring or retainer 228 engaging the surface 214 of the outer bearing 200 such that the outer bearing 200 is captured between the ring 228 and the outer shoulder 192. The ring 228 also has an annular tapered surface 232 which faces radially inwardly and which tapers radially away from the spindle 68 and axially away from the outer bearing 200 (to the left in FIG. 8).

Figure 8:
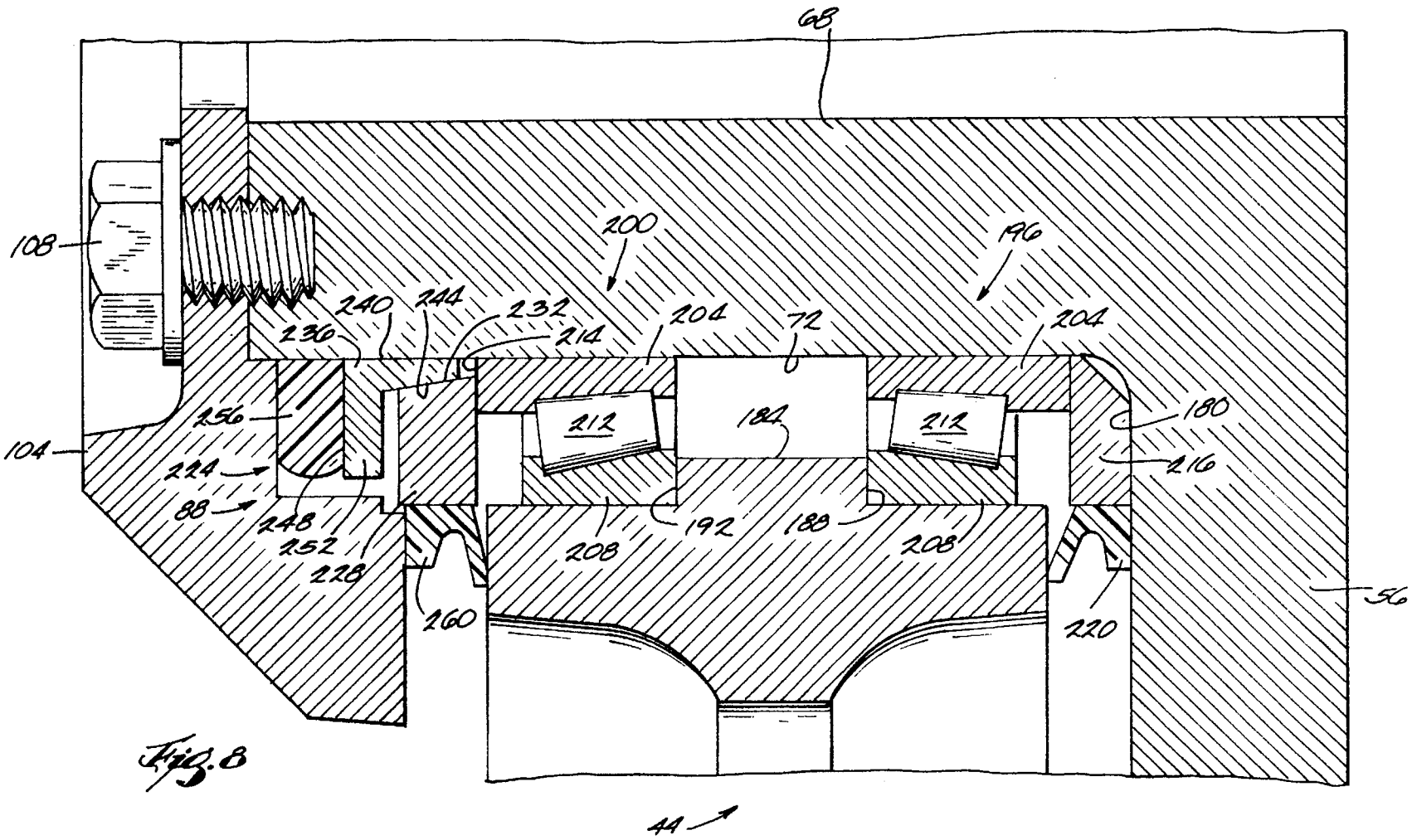
FIG. 8 is an enlarged portion of FIG. 6, with the sheave and frame partially shown.
Figure 9:
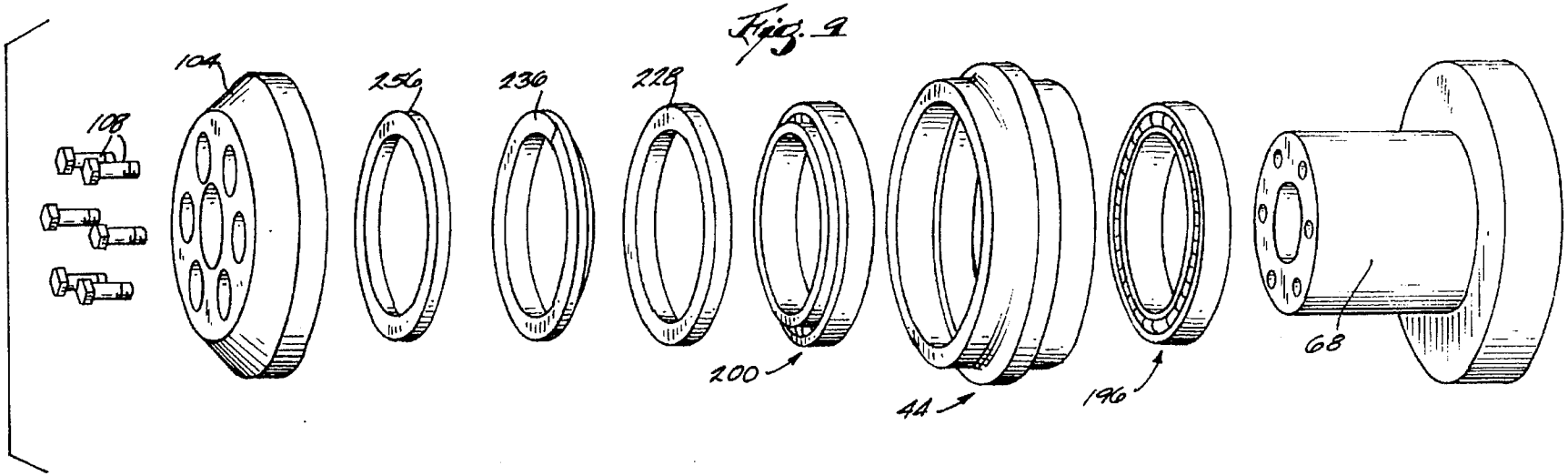
FIG. 9 is an exploded perspective view of the components shown FIG. 8.

The bearing retainer assembly 224 also includes a second or radially inner ring or retainer 236 having an axially extending inner surface 240 engaging the spindle outer surface 72. The ring 236 is split so as to have a variable diameter, whereby the ring 236 can conform to the spindle outer surface 72. The inner ring 236 also has a tapered surface 244 complementary with and engaging the tapered surface 232 of the outer ring 228. Thus, the tapered surface 244 of the inner ring 236 faces radially outwardly and tapers radially away from the spindle 68 and axially away from the outer bearing 200. The inner ring 236 also has a radially extending end surface 248 facing away from the outer bearing 200 (to the left in FIG. 8). As shown in FIG. 8, the ring 236 is preferably generally L-shaped in cross-section with a radially outwardly extending flange 252 overlapping the outer ring 228.

An annular spring 256 engages the end surface 248 of the inner ring 236. While the preferred spring 256 is a polyurethane spring washer, it should be understood that other suitable springs, such as a conical disk or a wave-type washer, could be employed. The end cap 104 engages the spring 256 so that the spring 256 is compressed between the end cap 104 and the inner ring 236 and exerts a force on the inner ring 236 whereby the inner ring 236 is wedged between the outer ring 228 and the spindle outer surface 72 due to engagement of the tapered surfaces 232 and 244. This effectively locks the rings 228 and 236 in position. The angle of the taper is calculated such that frictional forces between the spindle surface 72 and the inner ring 236 are greater than the axial separating force of the bearings. The spring 256 provides a predetermined preload on the bearings. It is not necessary to tighten the bolts 108 to a particular torque. If the end cap 104 is fully seated, the bearings are properly adjusted. This makes it much easier than with known arrangements to properly preload the bearings.

A seal 260 surrounds the outer ring 228 between the end cap 104 and the sheave 44. As shown in FIG. 8, the end cap 104 is closely adjacent the outer end of the outer ring 228 (i.e., the left end of the ring 228 in FIG. 8) so as to limit axially outward movement of the outer ring 228 (to the left in FIG. 8). In other words, the end cap 104 keeps the bearing assembly 88 from fully separating in the event the rings 228 and 236 slip or break.

Figure 11:
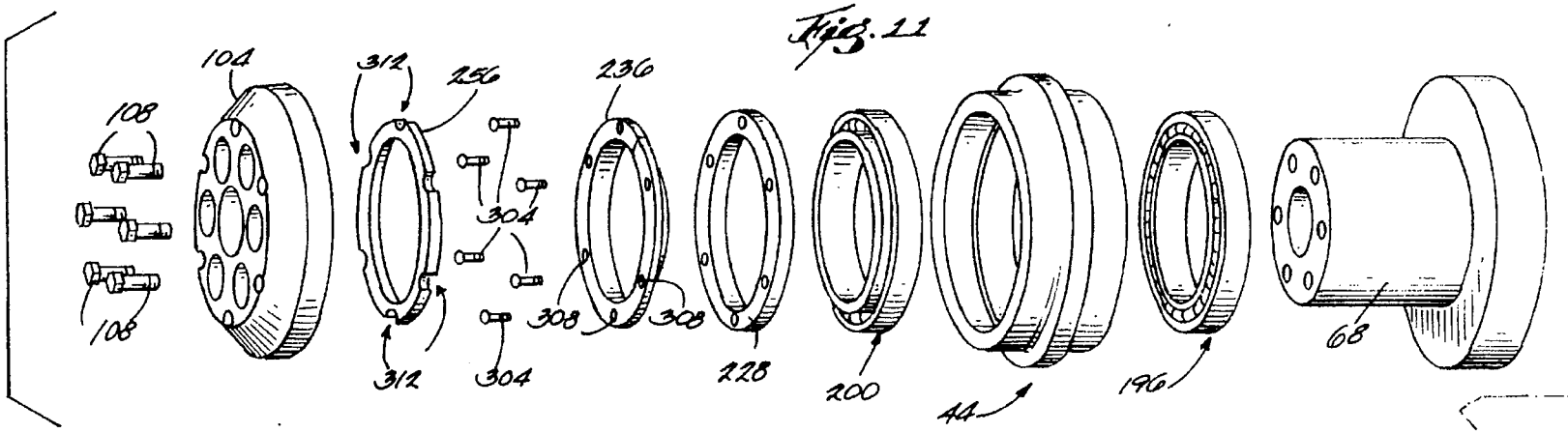
FIG. 11 is an exploded perspective view of the components shown in FIG. 10.
Figure 10:
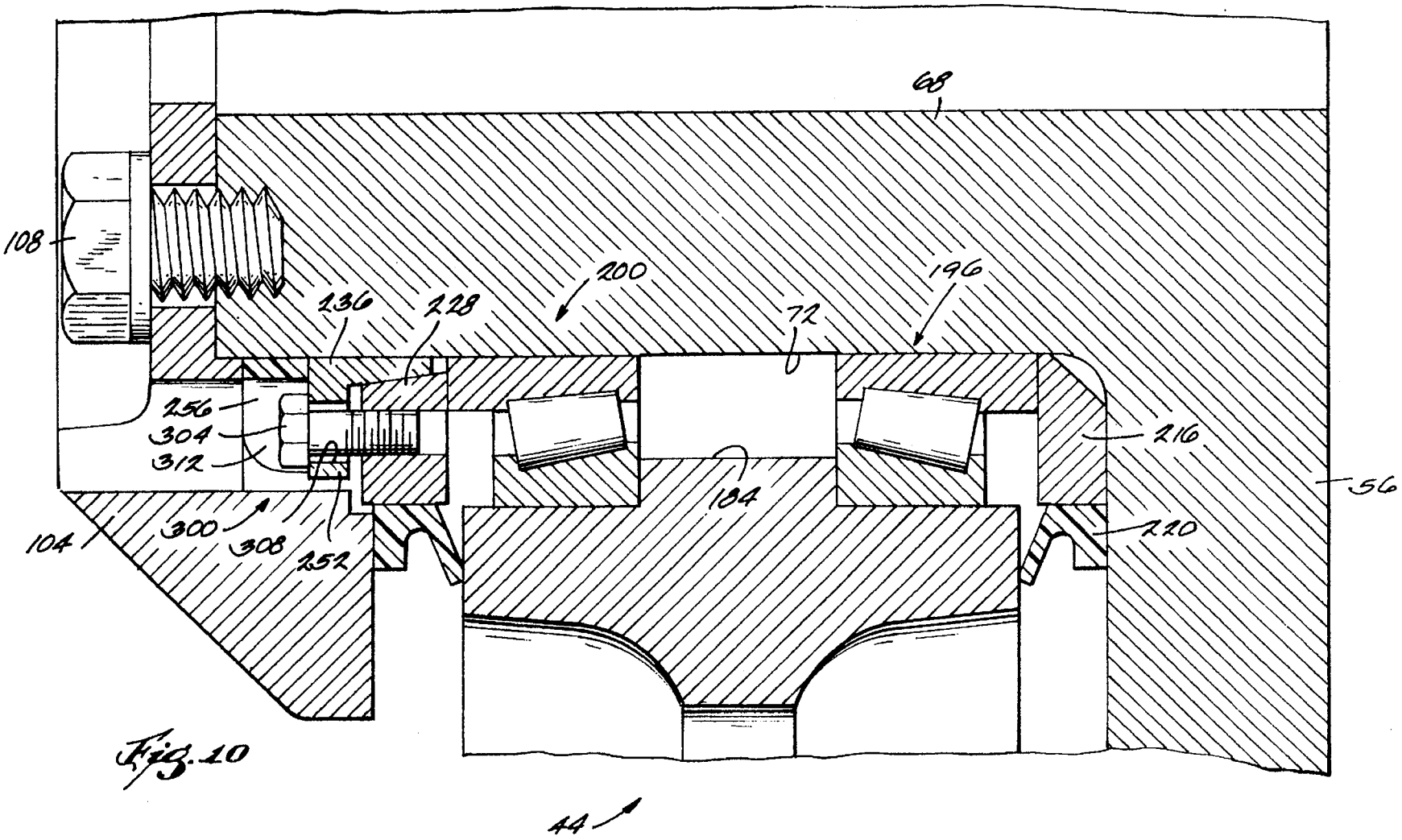
FIG. 10 is a view similar to FIG. 8 of an alternative bearing arrangement.

An alternative bearing retainer assembly 300 is illustrated in FIGS. 10 and 11. Except as described below, the bearing retainer assembly 300 is identical to the bearing retainer assembly 224, and common elements have been given the same reference numerals. The bearing retainer assembly 300 includes means for axially clamping the rings 228 and 236. While various suitable means can be employed, in the illustrated construction, such means includes a plurality of bolts 304 clampingly engaging the rings 228 and 236. More particularly, each bolt 304 extends through an aperture 308 in the inner ring flange 252 and is threaded into the outer ring 228. The apertures 308 in the inner ring 236 are large enough to allow some radial movement of the bolts 304 relative to the inner ring 236. The spring 256 has therein notches or cut-outs 312, each of which receives the head of a respective bolt 304 so that the bolt heads do not interfere with the spring 256. The bolts 304 are used to clamp the rings 228 and 236 in place and keep them from sliding relative to the spindle 68. This arrangement will allow for a preload or gap in the assembly as desired. Because the bolts 304 will draw the outer ring 228 back up onto the inner ring 236, the preload induced by the spring 256 will be reduced. If the reduction in the preload is less than the initial preload, a preload results. If the reduction in the preload is more than the initial preload, a gap results. It should be understood that this retainer assembly 300 can also be used with ball, cylindrical, or tapered roller bearings to provide a desired gap.

A dump block 400 having an alternative roller arrangement is illustrated in FIGS. 12 and 13. Except as described below, the dump block 400 is identical to the dump block shown in FIGS. 1–9, and common elements have been given the same reference numerals. Instead of the retaining assemblies 120 and 124, the dump block 400 has retaining assemblies 420 and 424. The retaining assemblies 420 and 424 are substantially identical, and only the assembly 424 will be described in detail.

The retaining assembly 424 includes a roller 128 mounted on a roller support 432. The roller support 432 is mounted on the frame main portion 56 such that the roller support 432 can pivot (see the arrows in FIGS. 12 and 13) relative to the frame 52 about an axis which is transverse to and extends radially from the sheave axis. The roller support 432 is pivotable relative to the frame 52 between a retaining position (see the assembly 420 in FIG. 12) and a release position (see the assembly 424 in FIG. 12). When the roller support 432 is in the retaining position, the roller axis is parallel to the sheave axis and the roller 128 extends over the sheave 44 to retain the dump rope 48 on the sheave 44. When the roller support 432 is in the release position, the roller 128 permits removal of the dump rope 48 from the sheave 44.

Means are provided for releaseably securing the roller support 432 in the retaining position. In the illustrated construction, the roller support has therein a slot 450, and the frame main portion 56 has therein (see FIG. 13) a notch 454 which is aligned with the slot 450 when the roller support 432 is in its retaining position. An L-shaped lever 458 is mounted on the roller support 432 for pivotal movement between a securing position (not shown) and a release position (see the assembly 424 in FIG. 12). When the lever 458 is in its securing position, the lever 458 is housed in the slot 450 and extends into the notch 454 to releaseably secure the roller support 432 in its retaining position. The lever 458 can be manually moved between its securing and release positions.

Various features of the invention are set forth in the following claims.

I claim:

1. A dragline comprising a main housing, a bucket hoist mechanism mounted on said housing, a bucket drag mechanism mounted on said main housing, a moving mechanism for moving said main housing over the ground, a boom which is supported on said main housing and which has an upper end, a rope guiding member on said upper end of said boom, a bucket, a hoist rope having one end connected to said bucket hoist mechanism, extending over said rope guiding member, and having an opposite end, a drag rope extending between said bucket and said bucket drag mechanism, a dump block including a frame having a main portion connected to said opposite end of said hoist rope, and a cantilevered spindle extending from said main portion, and a dump block sheave mounted on said spindle for rotation about a sheave axis, and a dump rope extending over said dump block sheave and having one end connected to said drag rope and an opposite end connected to said bucket, such that said dump rope can be removed from said sheave in the direction away from said frame main portion.

2. A dragline as set forth in claim 1 wherein said dump block also includes a retaining assembly including a retaining member mounted on said frame for movement relative to said frame between a retaining position in which said retaining member extends over said dump block sheave to retain said dump rope on said dump block sheave, and a release position in which said retaining member permits removal of said dump rope from said dump block sheave.

3. A dragline as set forth in claim 2 wherein said retaining member is a roller.

4. A dragline as set forth in claim 3 wherein said retaining assembly also includes a roller support mounted on said frame main portion for pivotal movement about a support axis transverse to said sheave axis, and wherein said roller is mounted on said roller support for rotation about a roller axis, said roller support being movable relative to said frame between a retaining position in which said roller axis is parallel to said sheave axis and said roller extends over said dump block sheave to retain said dump rope on said dump block sheave, and a release position in which said roller permits removal of said dump rope from said dump block sheave.

5. A dragline as set forth in claim 4 wherein said retaining assembly also includes means for releasably securing said roller support in said retaining position.

6. A dragline as set forth in claim 5 wherein said roller support has therethrough spaced first and second apertures, wherein said frame main portion has therein a third aperture which is aligned with said second aperture when said roller support is in said retaining position, wherein said roller support is pivotally mounted on said frame main portion by a first pin extending through said first aperture and along said support axis, and wherein said means for releasably securing said roller support includes a second pin insertable into said second and third apertures when said roller support is in said retaining position.

7. A dragline as set forth in claim 3 wherein said roller has thereon a flange for substantially preventing said dump rope from becoming wedged between said roller and said sheave.

8. A dragline as set forth in claim 1 wherein said dump block also includes a sheave support mounted on said spindle for rotation about said sheave axis, said sheave support having a radially extending shoulder, wherein said sheave is mounted on said sheave support, and wherein said dump block also includes a sheave guard which is fixed to said sheave support and which presses said sheave against said shoulder to hold said sheave on said sheave support.

9. A dragline comprising a main housing, a bucket hoist mechanism mounted on said housing, a bucket drag mechanism mounted on said main housing, a moving mechanism for moving said main housing over the ground, a boom which is supported on said main housing and which has an upper end, a rope guiding member on said upper end of said boom, a bucket, a hoist rope having one end connected to said bucket hoist mechanism, extending over said rope guiding member, and having an opposite end, a drag rope extending between said bucket and said bucket drag mechanism, a dump block including a frame having a main portion connected to said opposite end of said hoist rope, and a cantilevered spindle extending from said main portion, and a dump block sheave mounted on said spindle for rotation about a sheave axis, a dump rope extending over said dump block sheave and having one end connected to said drag rope and an opposite end connected to said bucket, and a retaining assembly including a roller mounted on said frame for movement relative to said frame between a retaining position in which said roller extends over said dump block sheave to retain said dump rope on said dump block sheave, and a release position in which said roller permits removal of said dump rope from said dump block sheave in the direction away from said frame main portion.

10. A dragline as set forth in claim 9 wherein said retaining assembly also includes a roller support mounted on said frame main portion for pivotal movement about a support axis transverse to said sheave axis, and wherein said roller is mounted on said roller support for rotation about a roller axis, said roller support being movable relative to said frame between a retaining position in which said roller axis is parallel to said sheave axis and said roller extends over said dump block sheave to retain said dump rope on said dump block sheave, and a release position in which said roller permits removal of said dump rope from said dump block sheave.

11. A dragline as set forth in claim 10 wherein said roller support has therethrough spaced first and second apertures, wherein said frame main portion has therein a third aperture which is aligned with said second aperture when said roller support is in said retaining position, wherein said roller support is pivotally mounted on said frame main portion by a first pin extending through said first aperture and along said support axis, wherein said retaining assembly also includes means for releasably securing said roller support in said retaining position, and wherein said means for releasably securing said roller support includes a second pin insertable into said second and third apertures when said roller support is in said retaining position.

12. A dragline as set forth in claim 9 wherein said roller has thereon a flange for substantially preventing said dump rope from becoming wedged between said roller and said sheave.

13. A dragline as set forth in claim 9 wherein said dump block also includes a sheave support mounted on said spindle for rotation about said sheave axis, said sheave support having a radially extending shoulder, wherein said sheave is mounted on said sheave support, and wherein said dump block also includes a sheave guard which is fixed to said sheave support and which presses said sheave against said shoulder to hold said sheave on said sheave support.

14. A dragline comprising a main housing, a bucket hoist mechanism mounted on said housing, a bucket drag mechanism mounted on said main housing, a moving mechanism for moving said main housing over the ground, a boom which is supported on said main housing and which has an upper end, a rope guiding member on said upper end of said boom, a bucket, a hoist rope having one end connected to said bucket hoist mechanism, extending over said rope guiding member, and having an opposite end, a drag rope extending between said bucket and said bucket drag mechanism, a dump block including a frame having a main portion connected to said opposite end of said hoist rope, and a cantilevered spindle extending from said main portion, a dump block sheave mounted on said spindle for rotation about a sheave axis, said dump block sheave having one side facing said frame main portion and an opposite side, an end cap securing said sheave on said spindle, and a sheave guard fixed relative to one of said sheave and said end cap to protect said opposite side of said dump block sheave, a dump rope extending over said dump block sheave and having one end connected to said drag rope and an opposite end connected to said bucket, and a retaining assembly including a roller support mounted on said frame main portion for pivotal movement about a support axis transverse to said sheave axis, and a roller mounted on said roller support for rotation about a roller axis, said roller support being movable relative to said frame between a retaining position in which said roller axis is parallel to said sheave axis and said roller extends over said dump block sheave to retain said dump rope on said dump block sheave, and a release position in which said roller permits removal of said dump rope from said dump block sheave.

15. A dragline as set forth in claim 14 wherein said retaining assembly also includes means for releasably securing said roller support in said retaining position.

16. A dragline as set forth in claim 15 wherein said roller support has therethrough spaced first and second apertures, wherein said frame main portion has therein a third aperture which is aligned with said second aperture when said roller support is in said retaining position, wherein said roller support is pivotally mounted on said frame main portion by a first pin extending through said first aperture and along said support axis, and wherein said means for releasably securing said roller support includes a second pin insertable into said second and third apertures when said roller support is in said retaining position.

17. A dragline as set forth in claim 14 wherein said roller has thereon a flange for substantially preventing said dump rope from becoming wedged between said roller and said sheave.

18. A dragline as set forth in claim 14 wherein said dump block also includes a sheave support mounted on said spindle for rotation about said sheave axis, said sheave support having a radially extending shoulder, wherein said sheave is mounted on said sheave support, and wherein said sheave guard is fixed to said sheave support and presses said sheave against said shoulder to hold said sheave on said sheave support.

19. A dragline comprising a main housing, a bucket hoist mechanism mounted on said housing, a bucket drag mechanism mounted on said main housing, a moving mechanism for moving said main housing over the ground, a boom which is supported on said main housing and which has an upper end, a rope guiding member on said upper end of said boom, a bucket, a hoist rope having one end connected to said bucket hoist mechanism, extending over said rope guiding member, and having an opposite end, a drag rope extending between said bucket and said bucket drag mechanism, a dump block including a frame having a main portion connected to said opposite end of said hoist rope, and a cantilevered spindle which extends from said main portion, and which has a sheave axis, an axially extending outer surface, and a radially outwardly extending spindle surface, a dump block sheave which is mounted on said spindle for rotation about said sheave axis and which has an axially extending inner surface, a tapered roller bearing between said inner and outer surfaces, said bearing having a radially extending bearing surface, and a bearing retainer assembly including an outer ring which engages said bearing surface so that said bearing is captured between said radially extending spindle surface and said outer ring, said outer ring having a first tapered surface facing radially inwardly, an inner, split ring having a second tapered surface which faces radially outwardly and which engages said first tapered surface, said split ring also having an axially extending ring surface engaging said outer surface of said spindle, and a radially extending ring surface, each of said first and second tapered surfaces tapering radially away from said spindle and axially away from said bearing, an annular spring engaging said ring surface, and a cap which is fixed to said spindle and which engages said spring so that said spring is compressed between said cap and said ring surface and forces said tapered surfaces against each other, and a dump rope extending over said dump block sheave and having one end connected to said drag rope and an opposite end connected to said bucket.

20. A dragline as set forth in claim 19 wherein said sheave has a first shoulder facing said radially extending spindle surface, and a second shoulder facing away from said first shoulder, wherein said dragline further comprises a second tapered roller bearing captured between said first shoulder and said radially extending spindle surface, and wherein said first-mentioned bearing is captured between said outer ring and said second shoulder.

21. A dragline as set forth in claim 19 wherein said spring is made of polyurethane.

22. A dragline as set forth in claim 19 wherein said bearing retainer assembly also includes means for axially clamping said rings.

23. A dragline as set forth in claim 22 wherein said means includes a plurality of threaded fasteners clampingly engaging said rings.

24. A dragline as set forth in claim 19 wherein said cap extends closely adjacent to said outer ring so as to limit axially outward movement of said outer ring relative to said inner member.

* * * * *